US010781801B2

(12) United States Patent
Carstensen et al.

(10) Patent No.: US 10,781,801 B2
(45) Date of Patent: Sep. 22, 2020

(54) AXIAL-PISTON MOTOR AND CYCLIC PROCESS DEVICE

(71) Applicant: VOLKSWAGEN AKTIENGESELLSCHAFT, Wolfsburg (DE)

(72) Inventors: Asmus Carstensen, Osloss (DE); Artur Semke, Wolfsburg (DE); Thomas Schulenburg, Isenbuettel (DE); Andreas Herr, Wolfsburg (DE); Marcus Dallmann, Meine (DE); Bernd Hupfeld, Gifhorn (DE); Holger Lange, Braunschweig (DE); Andre Horn, Braunschweig (DE); Michael Kaack, Roetgesbuettel (DE); Thomas Maischik, Sickte (DE); Uwe Kammann, Helmstedt (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 16/572,028

(22) Filed: Sep. 16, 2019

(65) Prior Publication Data

US 2020/0011306 A1 Jan. 9, 2020

Related U.S. Application Data

(63) Continuation of application No. PCT/EP2018/055605, filed on Mar. 7, 2018.

(30) Foreign Application Priority Data

Mar. 16, 2017 (DE) ..... 10 2017 105 610

(51) Int. Cl.
*F04B 1/143* (2020.01)
*F04B 1/122* (2020.01)
(Continued)

(52) U.S. Cl.
CPC ..... *F04B 1/143* (2013.01); *F04B 1/122* (2013.01); *F04B 1/145* (2013.01); *F04B 1/146* (2013.01)

(58) Field of Classification Search
CPC ..... F04B 1/122; F04B 1/143; F04B 1/145; F04B 1/146; F01B 3/02; F01B 3/0017; F01B 3/10; F01B 3/101
See application file for complete search history.

(56) References Cited

U.S. PATENT DOCUMENTS 5,018,351 A * 5/1991 Otte ..... F16D 31/08 60/448
8,950,184 B2 2/2015 Stegmaier et al.
(Continued)

FOREIGN PATENT DOCUMENTS

DE 10 2009 028 467 A1 2/2011
DE 10 2010 036 917 A1 2/2012
(Continued)

*Primary Examiner* — Thomas E Lazo
(74) *Attorney, Agent, or Firm* — Muncy, Geissler, Olds & Lowe, P.C.

(57) ABSTRACT

An axial piston motor having a cylinder housing, in which a plurality of cylinders are formed, and having pistons which are movably guided in the cylinders, wherein the pistons are attached to a swash plate and wherein a flow of a fluid that has entered via an inlet into the axial piston motor is controlled into and out of the cylinders by means of inlet and outlet valves, wherein the inlet and/or outlet valves comprise fluid change openings which are formed in a cylinder head plate and which can be temporarily released and covered by means of a rotary slide, for which purpose the rotary slide forms at least one passage opening.

10 Claims, 7 Drawing Sheets

(51) Int. Cl.
*F04B 1/145* (2020.01)
*F04B 1/146* (2020.01)

(56) References Cited

U.S. PATENT DOCUMENTS

| | | | |
|---|---|---|---|
| 2013/0318967 | A1 | 12/2013 | Gaertner et al. |
| 2018/0045172 | A1 | 2/2018 | Bucher et al. |

FOREIGN PATENT DOCUMENTS

| | | | | |
|---|---|---|---|---|
| DE | 10 2011 052 481 | A1 | 2/2012 | |
| DE | 10 2010 052 508 | A1 | 5/2012 | |
| DE | 10 2011 118 622 | A1 | 5/2013 | |
| DE | 10 2014 209 892 | A1 | 11/2015 | |
| DE | 10 2015 002 801 | A1 | 9/2016 | |
| DE | 10 2015 204 367 | A1 | 9/2016 | |
| DE | 102015204367 | A1 * | 9/2016 | ..... F01B 3/0017 |
| EP | 3 019 702 | A1 | 5/2016 | |

* cited by examiner

AXIAL-PISTON MOTOR AND CYCLIC PROCESS DEVICE

This nonprovisional application is a continuation of International Application No. PCT/EP2018/055605, which was filed on Mar. 7, 2018, and which claims priority to German Patent Application No. 10 2017 105 610.6, which was filed in Germany on Mar. 16, 2017 and which are both herein incorporated by reference.

BACKGROUND OF THE INVENTION

Field of the Invention

The present invention relates to an axial piston motor and to a cyclic process device having such an axial piston motor, used in the cyclic process device as an expansion device. The invention further relates to a drive unit for a motor vehicle having such a cyclic process device and to a motor vehicle having such a drive unit.

Description of the Background Art

Motor vehicles are currently mostly powered by internal combustion engines in which fuel is burned and the thermal energy released thereby is partially converted into mechanical work. The efficiency of reciprocating internal combustion engines, which are used almost exclusively for driving motor vehicles, is about one third of the primary energy used. Accordingly, two-thirds of the thermal energy released during combustion represents waste heat, which is discharged into the environment as heat loss either via the engine cooling system or the exhaust line.

Utilization of this waste heat represents a possibility for increasing the overall efficiency of a motor vehicle drive unit and thus reducing fuel consumption.

DE 10 2009 028 467 A1, which corresponds to U.S. Pat. No. 8,950,184, describes a device for utilizing the waste heat of an internal combustion engine. For this purpose, a first heat exchanger, the evaporator of a steam circuit process device, is integrated into the exhaust line of the internal combustion engine. The thermal energy transferred in the heat exchanger from the exhaust gas to a working medium of the steam circuit process device is partially converted in an expansion device into mechanical energy that can be used, for example, to support the drive of a motor vehicle or to generate electrical energy. Downstream of the expansion device, the working medium is cooled in a second heat exchanger, the condenser, whereby it condenses. A feed pump brings about an increase in pressure of the working medium and supplies it to the evaporator.

An axial piston motor, as is known from DE 10 2010 052 508 A1, which corresponds to US 2013/0318967, can be used as an expansion device in such a waste heat utilization system.

Axial piston motors have a cylinder housing in which a plurality of cylinders are formed in an annular arrangement. A piston is movably guided in each of the cylinders, wherein a phase shift in the piston positions is provided, which corresponds to the spacing between the cylinders with respect to a piston movement cycle ("piston cycle": TDC→BDC→TDC or BDC→TDC→BDC). In order to carry out a working stroke (TDC→BDC) of each piston, a fluid under pressure is introduced successively into the cylinders via inlet and outlet valves, which fluid brings about a movement of the respective piston and in so doing expands if necessary (in a pneumatic axial piston motor). The fluid is expelled again in an exhaust stroke (BDC→TDC) following the working stroke of each piston. The piston movements are transmitted to an output shaft via a plate which is disposed obliquely to the longitudinal axes of the cylinder and to which the pistons are attached directly or via connecting rods.

Axial piston compressors or pumps have a design substantially identical in comparison to axial piston motors, wherein mechanical drive power is transmitted from the shaft via the obliquely disposed plate to the pistons and thereby a rotational movement of the shaft or of an associated drive motor is translated into the cyclic movement of the pistons. In the working stroke (BDC→TDC) of the individual pistons, a fluid previously introduced into the cylinders during an intake stroke (TDC→BDC) is displaced and/or compressed and expelled.

Axial piston machines (axial piston motors and axial piston compressors or pumps) are usually made using one of three designs.

In the swash plate and bent axis design, the cylinder housing rotates together with the pistons. In the swash plate design, the shaft is disposed parallel to the cylinder housing and connected nonrotatably thereto. The oblique plate controlling the movement of the pistons is stationary. In the bent axis design, the longitudinal axes of the shaft, including of the flange ("inclined plate") on which the pistons engage, and of the cylinders run at an angle to one another.

In the swash plate design, the cylinder housing does not rotate with the pistons guided therein. The same applies to a swash plate to which the pistons are attached via connecting rods. The swash plate is rotatably mounted on a swash plate arm, wherein the bearing surface of the swash plate arm and thus the orientation of the swash plate are directed obliquely with respect to the longitudinal axes of the cylinders. The swash plate arm is connected nonrotatably to the shaft.

The inlet and outlet valves of axial piston machines are usually embodied in the form of one or more rotary slide valves, each of which comprises a rotary slide connected nonrotatably to the drive or output shaft and which depending on the particular piston positions temporarily connects inlet and/or outlet openings of the individual cylinders to an inlet or outlet of the axial piston machine. The sealing of the cylinder by means of the rotary slide valve is of particular importance for realizing the highest possible efficiency of an axial piston machine.

DE 10 2011 118 622 A1 discloses an axial piston machine in which both the inlet valves and the outlet valves are embodied in the form of rotary slide valves. In this case, the inlet valves are integrated into a cylinder head of the axial piston machine; i.e., the inlet openings temporarily covered by a rotary slide open into the cylinders on the front side. The outlet valves, in contrast, are arranged radially inward with respect to the cylinders, so that the outlet openings open into the circumferential surfaces of the cylinders. For the best possible sealing effect of the rotary slide valves, it is provided to press the two rotary slides each against a carbon bearing, wherein in order to keep the friction in the contact points between the rotary slides and the carbon bearings low, it is provided that the passage openings, which are arranged in the carbon bearings and which are connected in a fluid-conducting manner to the inlet or outlet openings of the cylinders, are formed with a protruding edge on which the rotary slides rest. The rotary slides are pressed against the carbon bearings either by a spring element or by the fluid under pressure.

Further, an axial piston machine is known from DE 10 2015 204 367 A1, which corresponds to US 2018/0045172, in which inlet openings likewise opening into the cylinder on the front side can be covered, as necessary, by means of a rotary slide, wherein an annular sealing element is disposed between the cylinder head, forming the inlet openings, and the rotary slide, which sealing element has passage openings covering the inlet openings and which is fixedly connected to the cylinder head.

SUMMARY OF THE INVENTION

It is therefore an object of the present invention to provide an axial piston motor, which is characterized by a good efficiency.

The invention is based on the idea that pressing of the rotary slide against the abutment, as is necessary to achieve a sufficient sealing, is required only in the circumferential section relative to the axis of rotation of the rotary slide, in which section at the particular time the inlet and/or outlet openings (fluid exchange openings) are located that belong to the cylinder(s) in which the piston(s) is (are) just now performing a working stroke. As a result, it was realized that to achieve sufficient sealing of the intake and/or outlet valves with simultaneous minimization of the frictional resistance generated by the rotary slide valve, it is sufficient to let only one section, extending over this part of the rotary slide, to press against the abutment of the rotary slide, whereby the size of the contact surfaces of the rotary slide and of the abutment, said surfaces which are pressed against one another, and in particular the size of the surface pair of these elements can be minimized, if contact of the surface pair with one another occurs at all. Because the frictional resistance at a given pressing force for sufficient sealing at least practically also depends on this surface size, it can therefore likewise be kept low.

Accordingly, according to an exemplary embodiment of the invention an axial piston motor having a cylinder housing is provided in which a plurality of cylinders are formed. Pistons are movably guided in the cylinders, wherein the pistons are attached to a swash plate and wherein a flow of a fluid that has entered via an inlet into the axial piston motor is controlled into and out of the cylinders by means of inlet and outlet valves. The inlet and outlet valves thereby comprise fluid change openings which are formed in a cylinder head plate (inlet and/or outlet openings, wherein combined inlet and outlet openings are possible and preferably provided) and which can be temporarily released and covered by means of a rotary slide, for which purpose the rotary slide forms at least one passage opening and a closed section. The rotary slide according to the invention comprises a sealing element which forms only a section of the rotary slide lower side facing the cylinder head plate and which is displaceably mounted in the direction of the cylinder head plate (preferably parallel to the axis of rotation of the rotary slide) in or on a base body of the rotary slide.

Only a section of the cylinder head plate surface covered overall by the rotary slide, which section comprises the fluid change openings associated with the cylinder or cylinders performing the working stroke, can be covered as required by means of the sealing element using a sufficiently high contact pressure by means of the rotary slide and specifically by means of the sealing element of the rotary slide, whereas contact with the cylinder head plate can be prevented for the section of the rotary slide lower side, said section not being formed by the sealing element, whereby the frictional resistance of the rotation of the rotary slide relative to the cylinder head plate can be kept low. This applies in particular if, as is preferably provided, the base body of the rotary slide is arranged at least in sections and preferably completely spaced from the cylinder head plate, so that it can be provided that only the sealing element comes into direct contact with the cylinder head plate, whereby the section the rotary slide lower side, which is not formed by the sealing element, is not only not pressed against the cylinder head plate under high pressure but preferably does not contact it at all.

An axial piston motor of the invention is preferably embodied according to the swash plate design and for this purpose comprises an inclined plate in the form of a swash plate to which the pistons are preferably attached via connecting rods. The swash plate rests rotatably on a swash plate arm, wherein the bearing surface of the swash plate arm and thus the orientation of the swash plate are directed obliquely with respect to the longitudinal axes of the cylinders. The swash plate arm is connected nonrotatably or at least in a rotation-transmitting manner to an (output) shaft.

According to an exemplary embodiment of an axial piston motor of the invention, it can be provided that the sealing element on the side facing away from the cylinder head plate is acted upon directly or indirectly by the inlet pressure of the fluid, i.e., by a pressure the fluid has before entering the cylinder. For this purpose, it can be provided that the sealing element on the side facing away from the cylinder head plate is connected in a fluid-conducting manner directly or indirectly to the inlet of the axial piston motor, so that the sealing element is pressed against the cylinder head plate by the fluid, which is still under relatively high pressure. This embodiment is based on the idea that in an axial piston motor a most advantageous (needs-based) sealing of the cylinder can be achieved by a rotary slide valve when the rotary slide is pressed by the still compressed fluid against an abutment forming at least one fluid change opening per cylinder, because the pressing force is thus directly dependent on the operating pressure of the fluid with which the axial piston motor is operated, so that good sealing is achieved at a relatively high fluid pressure due to a relatively high pressing force, whereas at a relatively low operating pressure of the fluid the pressing force is also relatively low which is then associated with only a relatively low frictional resistance of the rotation of the rotary slide relative to the abutment, if the sealing is still sufficient. Thus, it can be achieved that the frictional resistance is as low as possible depending on the actual applied operating pressure of the fluid with an always sufficiently tight cover. Such an axial piston motor of the invention can therefore be operated advantageously over a relatively wide range of fluid operating pressure.

Alternatively, however, it is also possible to press the sealing element against the cylinder head plate by means of other pressure components, for example, by means of one or more spring elements. This applies in particular if a relatively small range of the fluid operating pressure is provided for operating the axial piston motor.

According to an exemplary embodiment of such an axial piston motor of the invention, in which the sealing element is acted upon by the inlet pressure of the fluid, one or more pressure pistons movably mounted in the base body of the rotary slide can be provided, which bear directly or indirectly against the sealing element, wherein the side, facing away from the sealing element, of the pressure piston or pistons is acted upon directly or indirectly by the inlet pressure of the fluid (and for this purpose is connected to the inlet in a fluid-conductive manner). The inlet pressure of the fluid is thus transmitted indirectly to the sealing element via the pressure piston or pistons, which, among other things, makes possible a simplified internal sealing of the multipart rotary slide, because a design that is in particular cylindrical and simpler to seal, compared with the sealing element, can be optionally selected for the pressure pistons. In addition, the pressing force with which the sealing element is pressed against the cylinder head plate can be easily adjusted in this way, for example, by adjusting the surface of the piston or pistons exposed to the inlet pressure with respect to size and/or the distances between at least three pressure pistons.

In this regard, it can be particularly preferably provided that a plurality of pressure pistons are provided which are arranged distributed in the circumferential direction with respect to the axis of rotation, wherein the surfaces, exposed to the inlet pressure of the fluid, (of at least some) of these multiple pressure pistons are formed as increasing in the direction of rotation intended for the rotary slide and/or the distances between at least three adjacent pressure pistons as decreasing in the intended direction of rotation. This can advantageously take into account the fact that the pressure within the cylinders which are in a working stroke and are closed by the rotary slide valve is at its highest immediately after the introduction of the still highly pressurized fluid and that this fluid pressure due to the expansion of the fluid in such a cylinder decreases continuously until the end of the working stroke of the associated piston, so that, with decreasing pressure of the fluid within the cylinder closed by the rotary slide, the pressing forces with which those areas of the sealing element that currently cover the fluid change openings belonging to these cylinders are pressed against the cylinder head plate, can also be dimensioned smaller. This is advantageously possible, in the case of the pressure pistons being acted upon by the inlet pressure of the fluid, by means of the pressure piston surface acted upon by this inlet pressure of the fluid and/or by means of an adjustment of the distances between the pressure pistons.

A good internal sealing of the multipart rotary slide is advantageously attainable in particular when it is provided for covering as required both inlet openings, associated with the cylinders, and outlet openings (in particular also in the case of combined inlet and outlet openings), and the base body is made at least partially hollow for this purpose, wherein this cavity is connected to a first base body connection opening, which is connected in a fluid-conducting manner to preferably the inlet (or an outlet) of the axial piston motor, and to one or more second base body connection openings, which can be brought into overlap with the fluid change openings associated with the cylinders by rotation of the rotary slide. Furthermore, the rotary slide and in particular the base body can then also form one or more passage openings which bypass the cavity and which, in the event of overlapping (in each case) of a fluid change opening associated with a cylinder, connect the corresponding cylinder with preferably the outlet (or inlet) of the axial piston motor.

In an exemplary embodiment of an axial piston motor of the invention, it can be provided that the sealing element extends over a circumference of 180°±20°, preferably of substantially exactly 180°, with respect to the axis of rotation of the rotary slide. This ensures that a sufficiently tight covering of the fluid change openings occurs by means of the sealing element for each cylinder in the working cycle for the entire duration of the respective working cycle.

Alternatively, there is also the possibility that the sealing element extends over a circumference of up to and preferably of exactly 360° with respect to the axis of rotation of the rotary slide, whereby a simpler guiding of the sealing element with less risk of tilting can be realized in or on the base body. In particular, in such an embodiment of the sealing element, it can further preferably be provided that it has a plurality of passage openings, of which one serves as the entry port to be overlapped with an inlet opening and an exit port to be overlapped with an outlet opening of the rotary slide. As a result, such a sealing element, which preferably extends fully circumferentially, does not prevent expelling of the fluid from the cylinders in the exhaust stroke.

Preferably, it can be provided that the sealing element is embodied in the form of a partial or complete annular ring, whereby the sealing element can extend over a relatively large circumferential section with respect to the axis of rotation of the rotary slide, wherein at the same time its radial width and thus the contact surface pressed against the cylinder head plate can be kept small. A nonrotatable attachment of the sealing element to the axial piston motor shaft rotationally driving the rotary slide overall is therefore carried out preferably by means of the base body of the rotary slide.

A (steam) cyclic process device of the invention comprises a circuit for a fluid (working medium), wherein an evaporator (i.e., a first heat exchange device, which is provided for supplying thermal energy to the working medium), which is provided for evaporating and optionally also for superheating the working medium, an expansion device for expanding the fluid with the aim of generating mechanical power, a condenser (i.e., a second heat exchange device provided for removing the thermal energy from the working medium), which is provided for condensing the fluid, and a conveying device (in particular a pump) for conveying the fluid (preferably in the liquid state) into the circuit are integrated into the circuit. In this case, the expansion device is embodied in the form of an axial piston motor of the invention.

The invention further relates to a drive unit for a motor vehicle, which comprises at least one internal combustion engine, which has an engine and an exhaust line via which exhaust gas can be discharged from the engine. The drive unit further comprises a cyclic process device of the invention, wherein the evaporator is provided and configured to use the thermal energy of the engine's exhaust gas to evaporate the fluid.

The invention relates in addition to a motor vehicle comprising such a drive unit of the invention, wherein the internal combustion engine of the drive unit can be provided in particular for generating a drive power for the motor vehicle. The motor vehicle can in particular be a wheel-based motor vehicle (preferably a passenger car or a truck). Use in other motor vehicles, for example, in rail-bound motor vehicles or ships is also possible.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
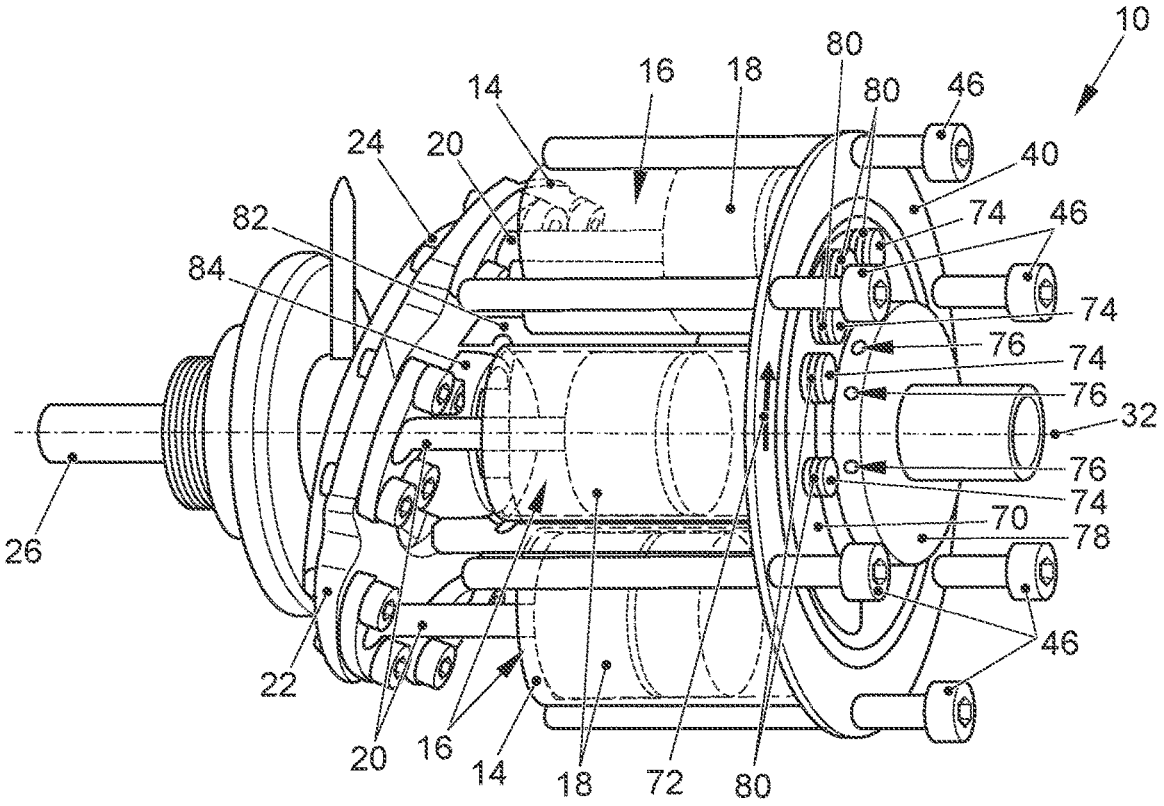
FIG. 1 shows an embodiment of an axial piston motor of the invention (shown only in part) in a perspective view.
Figure 2:
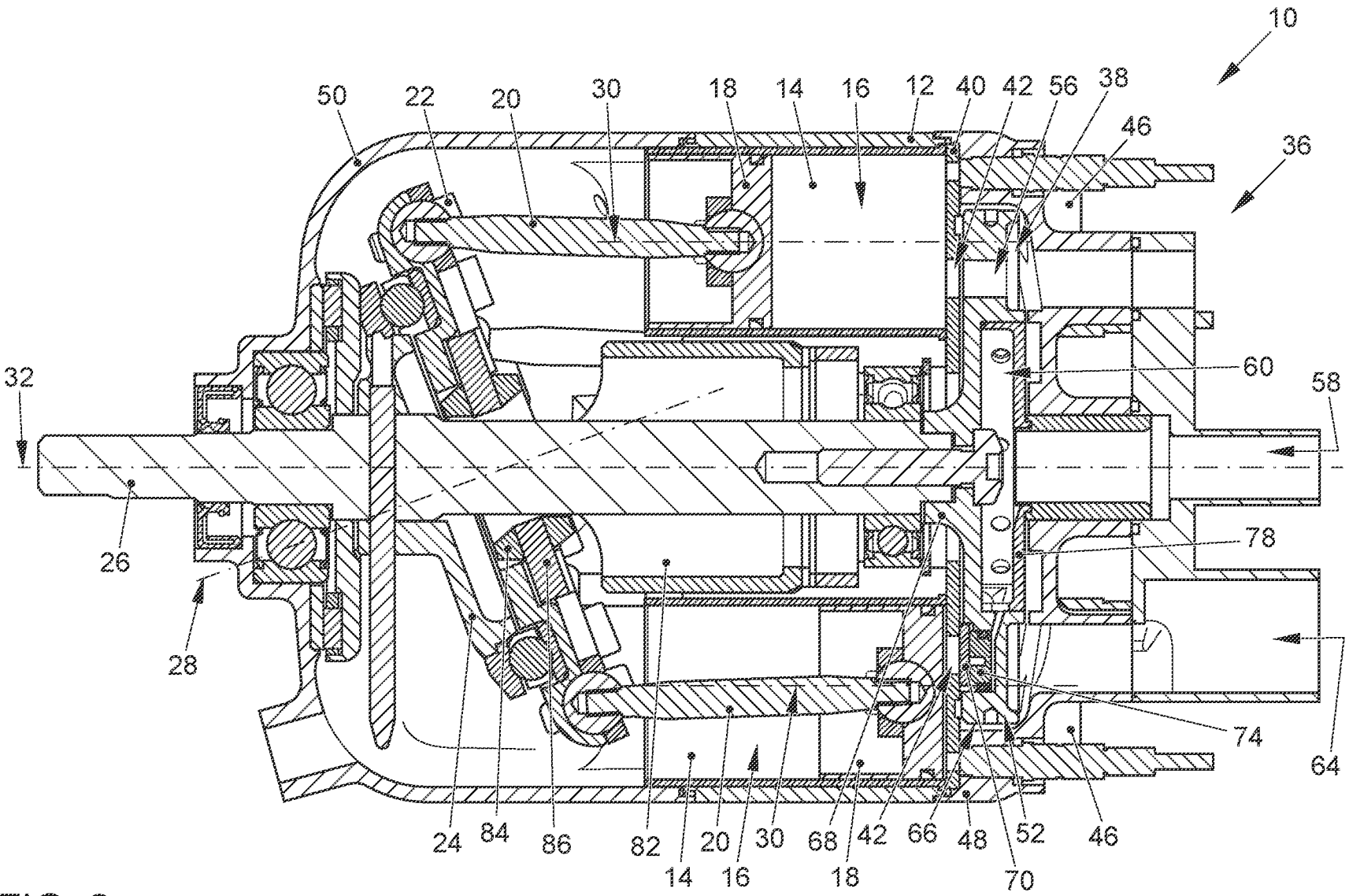
FIG. 2 shows the axial piston motor in a longitudinal section.
Figure 3:
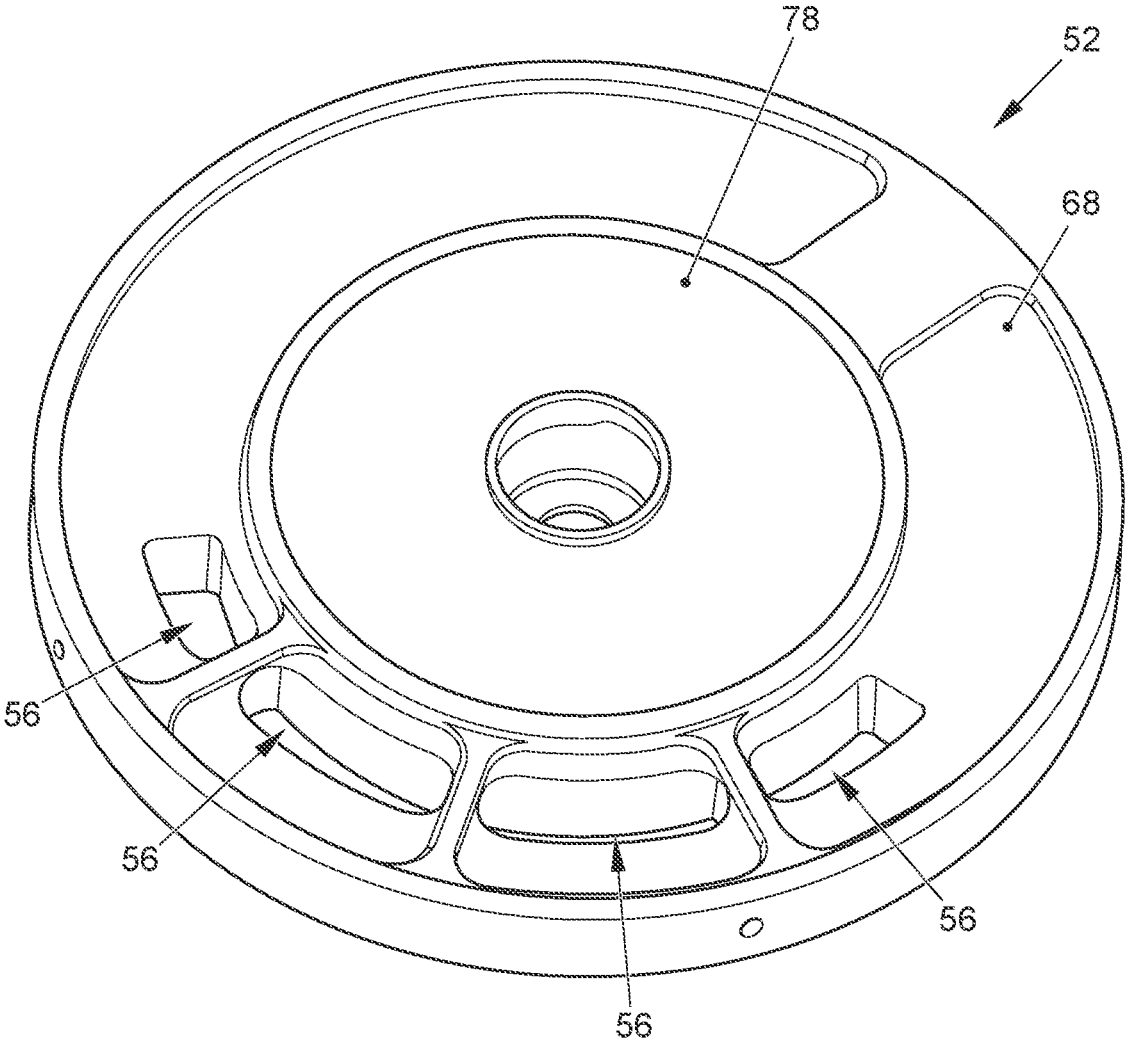
FIG. 3 shows the rotary slide of the axial piston motor in a perspective view.
Figure 4:
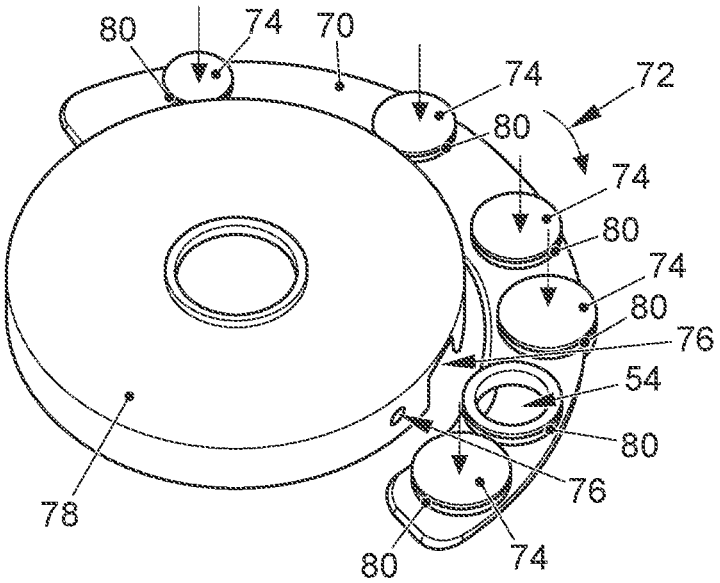
FIG. 4 shows the cover part, the sealing element, and the pressure pistons of the rotary slide in a perspective view.
Figure 5:
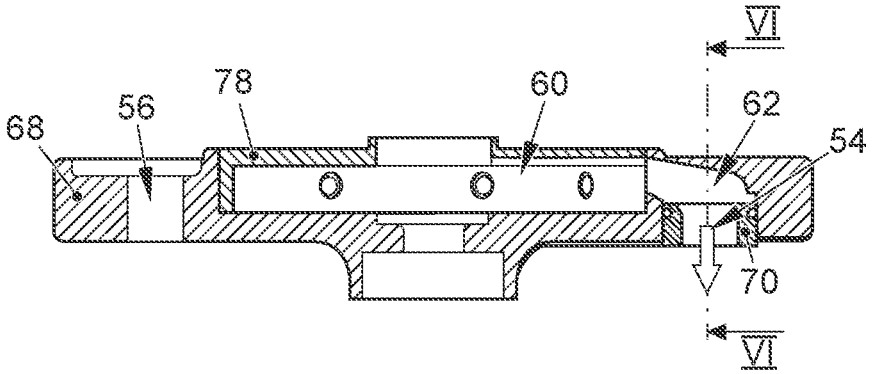
FIG. 5 shows a first radial section through the rotary slide.
Figure 6:
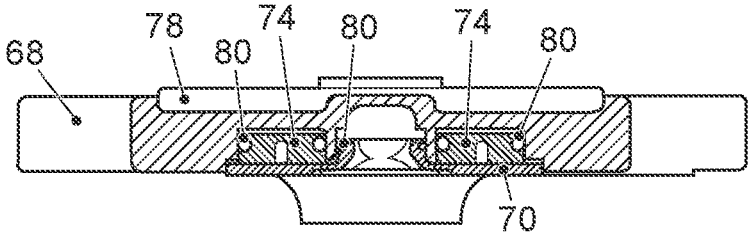
FIG. 6 shows a cross section through the rotary slide along the plane VI-VI in FIG. 5.
Figure 7:
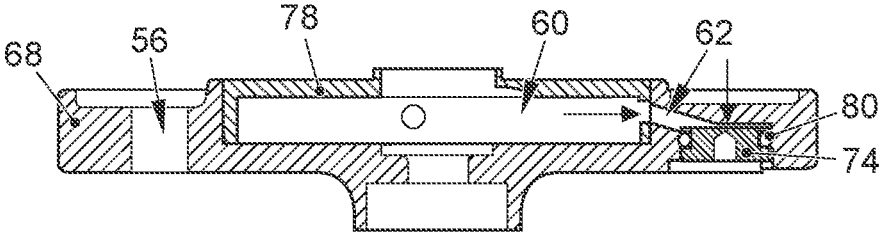
FIG. 7 shows a second radial section through the rotary slide.

FIGS. 1 to 8 show an embodiment of an axial piston motor 10 of the invention. Axial piston motor 10 is designed as a swash plate type. For this purpose, it comprises a multipart cylinder housing 12 which comprises a plurality (here: six) of cylinder tubes 14 oriented parallel to one another. Cylinder tubes 14 limit cylinders 16 in each of which a piston 18 is movably guided. Pistons 18 are each attached via a connecting rod 20 to an annular swash plate 22. Swash plate 22 is rotatably mounted on a swash plate arm 24 which is nonrotatably connected to an (output) shaft 26 of axial piston motor 10.

Swash plate 22 and swash plate arm 24 have (coaxial) longitudinal axes 28 which extend inclined at a defined angle to longitudinal axes 30, 32 of shaft 26 and cylinder 16.

Due to the inclined position of swash plate 22, the pressure of the fluid (working medium) successively entering individual cylinders 16 leads to a circumferentially directed force component in the connection points of connecting rod 20 to swash plate 22, wherein this force component is transmitted to swash plate arm 24 and thereby causes the desired rotation of shaft 26. As a result of the rotation of shaft 26 and of swash plate arm 24 connected nonrotatably thereto, swash plate 22 is set into a wobbling motion, which leads to an up-and-down movement of piston 18 connected to swash plate 22 via connecting rod 20. In this case, each piston 18 moves cyclically between a top dead center (TDC), close to a cylinder head 36, and a bottom dead center (BDC), remote from cylinder head 36.

The piston-cylinder units operate with two cycles. The movement of each piston 18 from the TDC to the BDC is brought about by the fluid flowing into the respective cylinders 16 (working stroke of the respective cylinder 16 and working stroke of the respective piston 18). In the case of the movement of pistons 18 guided by swash plate 22 from the BDC to the TDC, the fluid expanded during the preceding working stroke is expelled from the respective cylinders 16 (exhaust stroke of the respective cylinder 16 and exhaust stroke of the respective piston 18). The inflow and outflow of the fluid at the designated control times is controlled by inlet and outlet valves which are associated with cylinders 16 and which are formed as a combined rotary slide valve 38.

Rotary slide valve 38 comprises a cylinder head plate 40 which on the front side lies against cylinder housing 12 sealingly on the side spaced from swash plate 22. Cylinder head plate 40 has in each case a fluid change opening 42, serving as a combined inlet and outlet opening, for each cylinder 16. Further openings 44 (see FIGS. 1 and 8) are used to receive screws 46 by which a cylinder head housing 48, cylinder head plate 40, cylinder housing 12, and a housing 50 surrounding swash plate 22 and swash plate arm 24 are interconnected. A rotary slide 52, which is connected nonrotatably to shaft 26 and thus rotates relative to cylinder head plate 40 during operation of axial piston motor 10, is disposed on the side of cylinder head plate 40, said side being spaced from cylinders 16. In this way, fluid change openings 42 of cylinder head plate 40 are made to overlap alternately and once per revolution of shaft 26 with a first passage opening (entry port) 54 and with a second passage opening (exit port) 56 of rotary slide 52. Entry port 54 and exit port 56 are located on the same circular path about rotation axis 32 of rotary slide 52. In the case of an overlapping of entry port 54, the gaseous fluid is supplied to the respective cylinder 16 via a central inlet 58 of axial piston motor 10, a cavity 60 integrated into rotary slide 52, and a fluid channel 62 connecting cavity 60 to entry port 54 (cf. FIG. 5). In the case of an overlapping with exit port 56, the fluid is expelled from the respective cylinders 16 and discharged out of axial piston motor 10 via an outlet 64. In this case, the length of entry port 54 of rotary slide 52 (with regard to the intended direction of rotation 72 of rotary slide 52) is selected such that there is an overlap with only fluid change opening 42 of a cylinder 16, whereas the considerably longer exit port 56 of rotary slide 52 provides for the simultaneous release of multiple fluid change openings 42.

Rotary slide 52 and specifically a base body 66 of rotary slide 52 is designed in multiple parts for a design of cavity 60 that is advantageous in terms of manufacturing technology. It comprises a base part 68, which forms a central receiving recess into which a cover part 78 is inserted. Cover part 78 delimits cavity 60 with the upper side of base part 68 in the area of the receiving recess, wherein an opening in the circumferential surface of cover part 78 enables a fluid-conducting connection between cavity 60 and fluid channel 62.

In addition to base body 66, rotary slide 52 comprises a sealing element 70, which in the exemplary embodiment according to FIGS. 1 to 8 is formed as a partially annular sealing plate which extends over a circumferential angle (with respect to the axis of rotation of the rotary slide) of approximately 180°. Entry port 54 of rotary slide 52 is formed in this sealing element 70.

Figure 9:
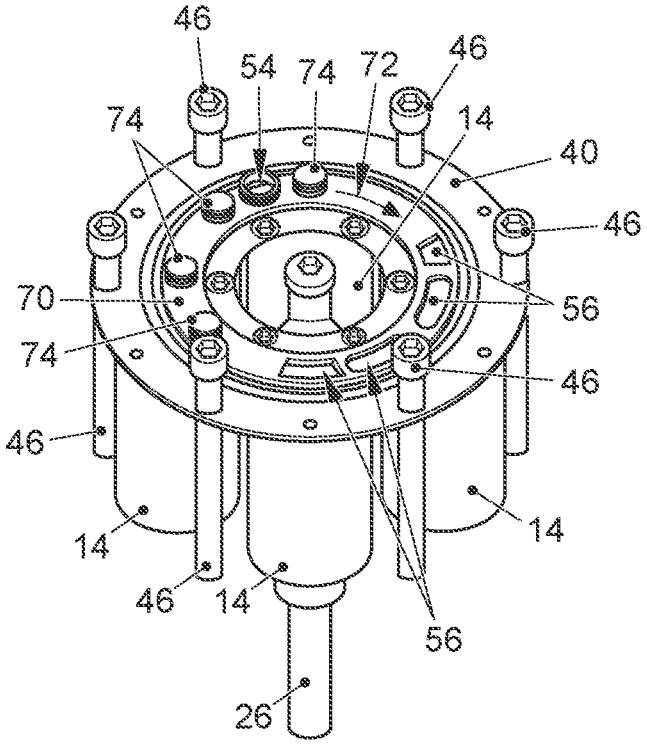
FIG. 9 shows in a perspective view parts of an axial piston motor of the invention according to FIGS. 1 and 2 in an alternative embodiment of the sealing element.

In the embodiment of rotary slide 52 according to FIG. 9, in contrast, a complete, i.e., extending over a circumferential angle of 360°, annular sealing element 70 (sealing plate) is provided, which in addition to entry port 54 forms a passage opening which is divided by structurally stabilizing partitions into multiple sections and which represents a section of exit port 56 formed by rotary slide 52.

The closed sections (i.e., not forming entry port 54 and, in the exemplary embodiment according to FIG. 9, also not exit port 56) of sealing element 70 are used to cover fluid change openings 42 as needed, wherein at least the section located in the direction of rotation 72 of rotary slide 52 behind entry port 54, due to the nonrotatable coupling of rotary slide 52 via shaft 26 to swash plate arm 24, is always disposed such that it is located in the region of the three cylinders 16 in which the associated pistons 18 currently perform a working stroke during operation of axial piston motor 10.

Sealing element 70 (in both exemplary embodiments) is movably disposed in a (partial) annular receiving recess, which is formed by the lower side of base body 66, said lower side being adjacent to cylinder head plate 40, wherein a displacement of sealing element 70, possible over a relatively small distance, is possible in the directions parallel to axis of rotation 32 of rotary slide 52 and thus toward cylinder head plate 40 or away from it. This enables sealing element 70 to be pressed against cylinder head plate 40 as needed, as a result of which fluid change openings 42, covered by the closed section of sealing element 70, are not only covered, but also the gap, formed between this section of sealing element 70 and cylinder head plate 40, is sealed sufficiently due to a sufficiently high force with which sealing element 70 is pressed against cylinder head plate 40.

On the other hand, it is provided that the lower side of base body 66 is located at a defined, relatively small distance (e.g., about 3/10 mm) from the upper side of cylinder head plate 40, whereby contact between base body 66 and cylinder head plate 40 and thus friction losses due to the rotation of base body 66 relative to cylinder head plate 40 are prevented. Consequently, a contact between rotary slide 52 and cylinder head plate 40 is provided only in the areas of the sections, formed closed, of sealing element 70, whereby the size of this contact surface is reduced to the extent required for the sealed covering of fluid change openings 42 of cylinders 16 in which currently the associated pistons 18 perform a working stroke. As a result, friction losses resulting from the rotation of rotary slide 52 relative to cylinder head plate 40 are minimized. These friction losses can be kept particularly low if the materials from which cylinder head plate 40 (e.g., steel) and sealing element 70 (e.g., copper) are formed are also selected with regard to the lowest possible coefficient of friction. Furthermore, there is the possibility of coating cylinder head plate 40 and/or sealing element 70 with a friction-reducing plain bearing material (e.g., PTFE or DLC (diamond-like carbon)). Among other things, sealing element 70 can advantageously also be made of steel.

Sealing element 70 is pressed against cylinder head plate 40 by means of multiple pressure pistons 74, which are arranged distributed along the sections, formed closed, and which are displaceably mounted (along axis of rotation 32) in a respective cylindrical receiving opening of base body 66 and which are acted upon on their upper side by the fluid flowing in via inlet 58 into cavity 60 of rotary slide 52 and thus by the inlet pressure of the fluid. For this purpose, in each case a fluid channel 62 leading to each pressure piston 74 is formed in base part 68 of base body 66 (cf. FIG. 7), which in each case has a fluid-conducting connection with cavity 60 via an associated opening 76 in the circumferential surface of cover part 78 (cf. FIG. 4). A sealing ring 80 (O-ring) is provided in each case to seal the circumferential gap between the circumferential surfaces of pressure pistons 74 and the boundary walls of receiving openings receiving these.

Pressure pistons 74, acted upon by the inlet pressure of the fluid, press sealing element 70 against cylinder head plate 40, thereby achieving the previously described sealed covering of fluid change openings 42 of the cylinders 16 whose associated pistons 18 perform a working stroke. In this case, the force with which sealing element 70 is pressed against cylinder head plate 40 is directly dependent on the level of the fluid inlet pressure, so that at each actual inlet pressure level provided during operation of axial piston motor 10, on the one hand, a sufficient sealing is achieved and, on the other, an unnecessarily strong pressing of sealing element 70 against cylinder head plate 40 and thus an unnecessarily high frictional resistance for the rotation of rotary slide 52 relative to cylinder head plate 40 are prevented.

Figure 8:
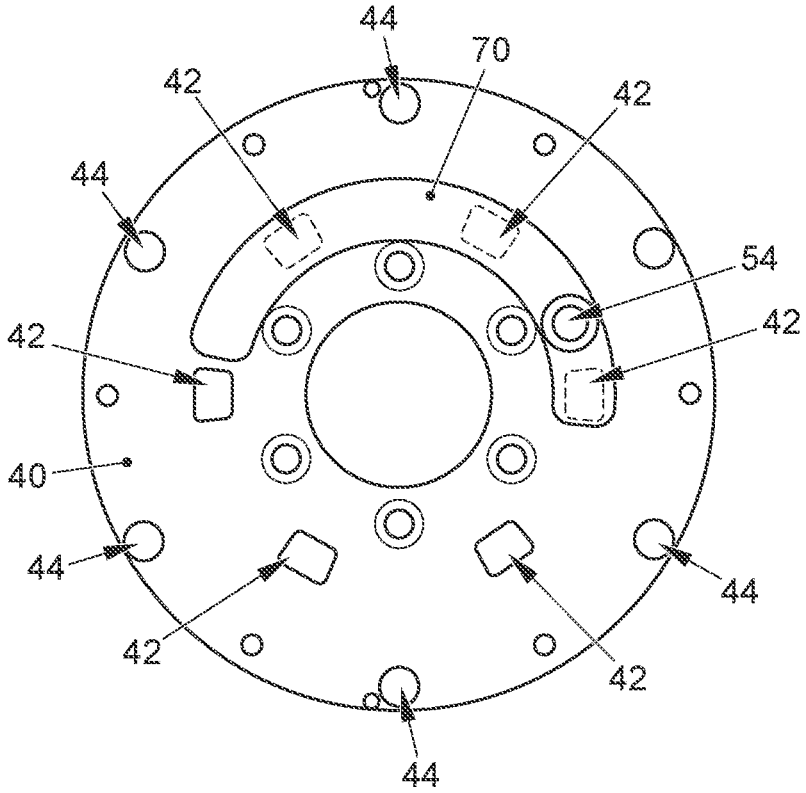
FIG. 8 shows a top plan view of the cylinder head plate and the sealing element of the axial piston motor.

In the case of sealing element 70 (of both embodiments), a closed section upstream of entry port 54 is provided, whose length in the circumferential direction corresponds at least to the width of fluid change openings 42 in the circumferential direction (cf. in particular FIGS. 8 and 9). This ensures that also if entry port 54 of sealing element 70 is only initially covered by the individual fluid change openings 42 of cylinder head plate 40, all of the fluid flowing into the respective cylinder 16 remains therein and does not flow out again via a gap which is still formed initially before sealing element 70. Pressing of sealing element 70 by means of a pressure piston 74 is also provided in this section upstream of entry port 54 (cf. FIGS. 4 and 9). By varying the length of this closed section of sealing element 70, said section being upstream of entry port 54, a precompression of the fluid still remaining in cylinders 16 can be realized and adjusted in that this section of sealing element 70 already covers fluid change openings 42, before the associated pistons 18 have reached their TDC.

Furthermore, a pressure piston 74 is provided immediately behind (with respect to direction of rotation 72) entry port 54 and is followed by multiple further pressure pistons 74. It is provided that, on the one hand, the surfaces of the upper sides of pressure pistons 74, which are exposed to the inlet pressure of the fluid, are formed as increasing in direction of rotation 72 and, on the other hand, the distances between pressure pistons 74 are formed as decreasing in the direction of rotation, as a result of which a particular strong pressing of sealing element 70 against cylinder head plate 40 in a region comprising entry port 54 is achieved, whereas the contact pressure becomes smaller with increasing distance from entry port 54, whereby the contact forces generated by the individual pressure pistons 74 and acting on different regions of sealing element 70 are adapted to the fluid pressure progressively decreasing during the working cycles in cylinders 16.

In order to prevent swash plate 22 from being carried along by the rotational movement of swash plate arm 24, it is provided to connect it, secured against rotation, to cylinder housing 12. A safety sleeve 82 is provided for this purpose, which is connected to cylinder housing 12. Safety sleeve 82 is also connected to swash plate 22 via a cardan-like joint assembly. The joint assembly connects swash plate 22 nonrotatably to safety sleeve 82 and thus to cylinder housing 12 and at the same time allows the wobbling movement of swash plate 22. The joint assembly comprises a joint ring 84, which is connected, rotatable about a first axis, to safety sleeve 82 via two bearing pins 86 each and to swash plate 22, rotatable about a second axis perpendicular to the first axis.

Figure 10:
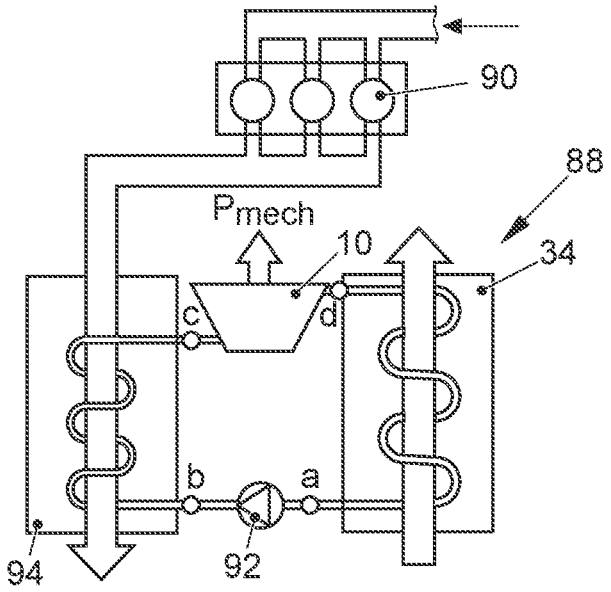
FIG. 10 shows a cyclic process device of the invention in a schematic illustration.

Axial piston motor 10 can be used, for example, in a cyclic process device 88 for utilizing the waste heat of an engine 90 of an internal combustion engine of a motor vehicle (cf. FIG. 10). In this process, a vaporized, superheated, and pressurized fluid expands in axial piston motor 10, whereby a portion of the thermal and potential energy of the fluid is converted into mechanical energy or power ($P_{mech}$). For this purpose, the fluid is conveyed in the liquid state by means of a pump 92 (conveying device) to an evaporator 94 in which it is heated by the transfer of thermal energy from the exhaust gas discharged from engine 90 via exhaust gas line integrating evaporator 94. The thus vaporized and superheated fluid then flows to axial piston motor 10 serving as the expansion device of the cyclic process device and from there in an expanded state to a condenser 34 of cyclic process device 88. In condenser 34, the fluid is cooled by a heat transfer to a cooling medium, for example, to a coolant flowing in a motor vehicle cooling system also integrating engine 90. In this case, the fluid condenses, so that it can again be supplied to evaporator 94 in the liquid state by means of pump 92. Due to the conveyance of the liquid fluid by means of pump 92, compression of the fluid, present in the gaseous state between evaporator 94 and axial piston motor 10 (expansion device), to an intended operating pressure is also achieved, wherein the pressure generation by means of pump 92 interacts with the expansion of the gaseous fluid in axial piston motor 10.

Figure 11:
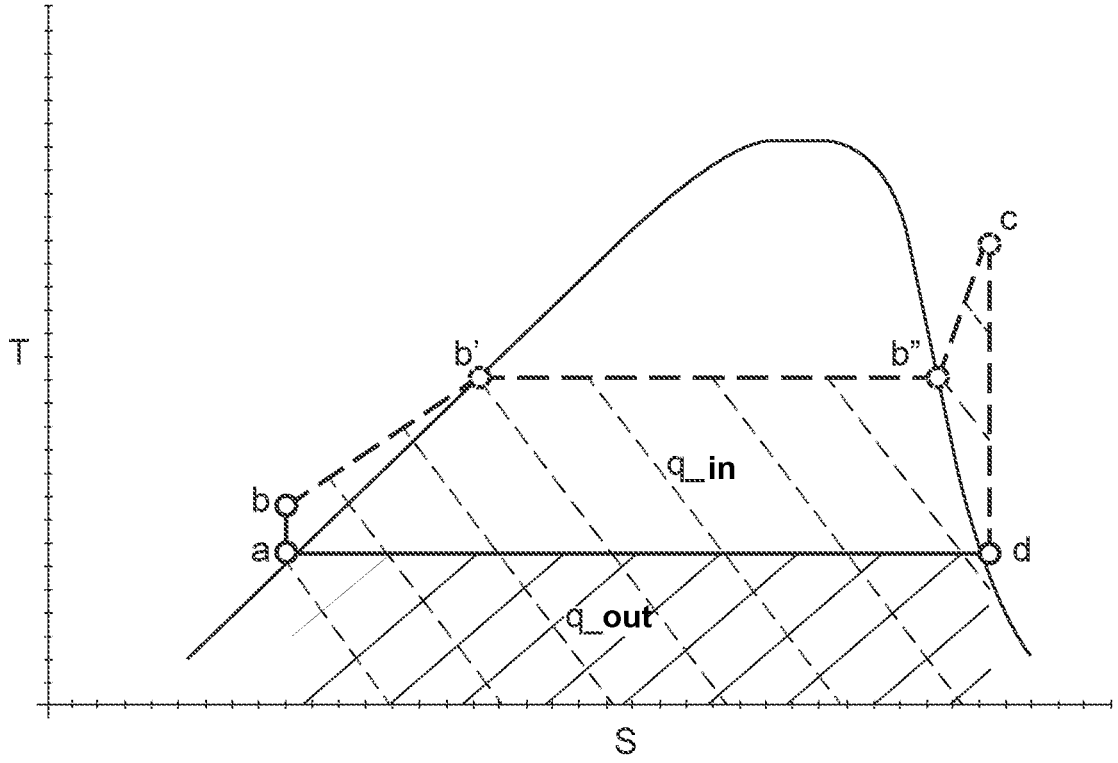
FIG. 11 shows a T-s diagram for a Clausius-Rankine process that can be performed by means of the cyclic process device.

Due to the work of pump 92, the pressure level is approached (theoretically) adiabatically and isentropically to a specified value according to the T-s diagram of FIG. 11 and a defined volume flow is ensured. A (theoretically) isobaric heat supply with evaporation and superheating takes place from state point b to state point c. Starting at state point b', evaporation begins, which is completed when state point b" is reached. The vaporous fluid is superheated from state point b" to state point c. The output of mechanical work ($P_{mech}$) by axial piston motor 10 (expansion device) takes place by a (theoretically) isentropic expansion from state point c to state point d. Depending on the type and structure of the expansion device, expansion is now possible until just before the vapor region or into the wet vapor region. From state point d to state point a, the fluid is (theoretically) isobarically and isothermally liquefied by the condenser.

The aim of the approach in the T-s diagram is a maximization of the supplied heat from state point b to state point c and a reduction of the heat (q_out) to be removed from state point d to state point a. The enclosed area from state point a via state points b and c to state point d should be maximized in the intended temperature range. The efficiency of a Clausius-Rankine process can thus be interpreted visually as the ratio of both areas ($\eta_{th}$=1−(q_out)/(q_in)).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An axial piston motor comprising:

a cylinder housing, in which at least two cylinders are arranged; and at least two pistons that are movably guided in the cylinders, the pistons being attached to a swash plate, and wherein a flow of a fluid that has entered via an inlet into the axial piston motor is controlled into and out of the cylinders by means of inlet and outlet valves, wherein the inlet and/or outlet valves comprise fluid change openings, which are formed in a cylinder head plate and which can be temporarily released and covered by a rotary slide, for which purpose the rotary slide forms at least one passage opening, wherein the rotary slide comprises a sealing element that forms only a section of the lower side of the rotary slide, the side facing the cylinder head plate, and which is displaceably mounted in the direction of the cylinder head plate in or on a base body of the rotary slide.

2. The axial piston motor according to claim 1, wherein the base body of the rotary slide is arranged at least in sections spaced from the cylinder head plate.

3. The axial piston motor according to claim 1, wherein the sealing element on the side facing away from the cylinder head plate is acted upon directly or indirectly by the inlet pressure of the fluid.

4. The axial piston motor according to claim 3, further comprising one or more pressure pistons movably mounted in the base body of the rotary slide and bearing directly or indirectly against the sealing element, wherein the side, facing away from the sealing element, of the pressure piston or pistons is acted upon directly or indirectly by the inlet pressure of the fluid.

5. The axial piston motor according to claim 4, wherein a plurality of pressure pistons are provided which are arranged spaced in the circumferential direction with respect to the axis of rotation of the rotary slide, wherein the surfaces, exposed to the inlet pressure of the fluid, of these pressure pistons are formed as increasing in the intended direction of rotation of the rotary slide and/or the distances between at least three pressure pistons as decreasing in the intended direction of rotation.

6. The axial piston motor according to claim 1, wherein the sealing element extends over a circumferential section of 180°±20° with respect to the axis of rotation of the rotary slide.

7. The axial piston motor according to claim 1, wherein the sealing element extends over a circumference of 360° with respect to the axis of rotation of the rotary slide.

8. The axial piston motor according to claim 1, wherein the sealing element has a plurality of passage openings, of which at least one serves as an entry port and at least one as an exit port of the rotary slide.

9. The axial piston motor according to claim 1, wherein the sealing element is a partial or complete annular ring.

10. A cyclic process device comprising a circuit for a fluid, wherein an evaporator for evaporating the fluid, an expansion device for expanding the fluid, a condenser for condensing the fluid, and a conveying device for conveying the fluid in the circuit are integrated into the circuit, and wherein the expansion device is an axial piston motor according to claim 1.

* * * * *